US005779305A

United States Patent [19]

Hocking

[11] Patent Number: 5,779,305

[45] Date of Patent: Jul. 14, 1998

[54] WORK STATIONS

[76] Inventor: Rory Hocking, Bulls Run Road, RD 1, Plimmerton, New Zealand

[21] Appl. No.: 750,315

[22] PCT Filed: May 26, 1995

[86] PCT No.: PCT/NZ95/00043

§ 371 Date: Nov. 25, 1996

§ 102(e) Date: Nov. 25, 1996

[87] PCT Pub. No.: WO95/32647

PCT Pub. Date: Dec. 7, 1995

[30] Foreign Application Priority Data

May 27, 1994 [NZ] New Zealand ..... 260620

[51] Int. Cl.[6] ..... A47C 7/62

[52] U.S. Cl. ..... 297/217.4; 297/170; 297/171; 297/188.21; 297/423.3

[58] Field of Search ..... 297/217.4, 217.7, 297/170, 172, 171, 188.01, 188.21, 411.21, 423.3, 344.12

[56] References Cited

U.S. PATENT DOCUMENTS

| | | | |
|---|---|---|---|
| 1,455,824 | 5/1923 | Wolfe . | |
| 3,311,411 | 3/1967 | Page et al. | 297/170 |
| 3,524,676 | 8/1970 | Cocherell et al. . | |
| 4,779,922 | 10/1988 | Cooper | 297/171 X |
| 4,880,270 | 11/1989 | Cooper . | |
| 5,054,852 | 10/1991 | Tholkes . | |
| 5,056,864 | 10/1991 | Cooper | 297/188.21 |
| 5,315,726 | 5/1994 | Borenstein | 297/423.3 X |

FOREIGN PATENT DOCUMENTS

| | | | |
|---|---|---|---|
| 2 673 820 A1 | 9/1992 | France . | |
| 2737349 | 2/1978 | Germany | 297/172 |
| 4 105 372 C1 | 1/1992 | Germany . | |

*Primary Examiner*—Laurie K. Cranmer
*Attorney, Agent, or Firm*—Popovich & Wiles, P.A.

[57] ABSTRACT

A work station which includes a chair and means to support pieces of equipment such as a personal computer, a printer and the like. The station has at least two upright stanchions (4,5) which project upwardly in a substantially parallel manner from a base (6). Sleeves (e.g. 8*a*) are engaged on the stanchions and the sleeves can act as spacers. Support members for the pieces of equipment are attached individually or in combination to a sleeve or sleeves so the support members will extend from the sleeves in a direction substantially normal to the longitudinal axis of the stanchions. The chair is supported between the stanchions at the desired height by being attached to the sleeves which are engaged on the stanchions. The work station can also include an electrical power reticulation system, a sound system and a lighting arrangement.

5 Claims, 2 Drawing Sheets

WORK STATIONS

This invention relates to a work station.

TECHNICAL FIELD

Work stations are generally used in office situations so that various pieces of equipment can be amalgamated into one location and thus be readily at hand to the operator with the intention of improving not only the efficiency of use of the pieces of equipment but also the use of floor space. Typically, pieces of equipment may consist of a personal computer, keyboard and monitor, a printer or printers connected to the personal computer, a filing and/or storage unit, a chair on which the operator may be seated and a work table.

While work stations as such are known, they generally are of a fixed variety, that is the desk or work table is in a permanent or semi permanent location with the desk or work table being so arranged or formed that the various items of equipment may be suitable positioned either on the desk or adjacent the desk such as on auxiliary platforms and the like. It is apparent that a purpose designed work station which includes a chair and a work table and which will also have the facility to effectively locate the items of equipment in an efficient arrangement would have considerable advantages over the known forms of work stations.

OBJECT OF THE INVENTION

It is therefore an object of this invention to provide an improved work station which will meet the above desiderata or at least provide the public with a useful choice.

DISCLOSURE OF THE INVENTION

Accordingly, one form of the invention may be said to comprise work station having a chair base, at least two stanchions projecting upwardly from the chair base, a plurality of sleeves engaged on each of the said stanchions, a support members attached to at least one of said sleeves to extend from said sleeve in a direction substantially normal to the longitudinal axis of the stanchion, said support member being adapted to support an item of equipment and wherein the work station also includes a chair is supported on the said stanchions by chair sleeves attached to said chair, which sleeves are engaged over at least two of said stanchions with the height of the chair above the chair base being determined by locating sleeves on the stanchions between the chair base and the chair sleeve.

Preferably also the work station includes an overhead lighting arrangement.

Preferably the chair comprises a back rest, a foot rest and a seat, the said foot rest being pivotally connected to the said seat in a manner that the angle between the foot rest and the seat can be varied.

Preferably the said stanchions extend from the chair base substantially parallel to each other.

Preferably the work station includes an electric power reticulation system to house electric power and/or data communication lines.

Preferably the work station includes means to transduce electrical signals into audible sound.

Preferred forms of the invention will now be described with the aid of the accompanying drawings wherein:

MODES OF CARRYING OUT THE INVENTION

Figure 1:
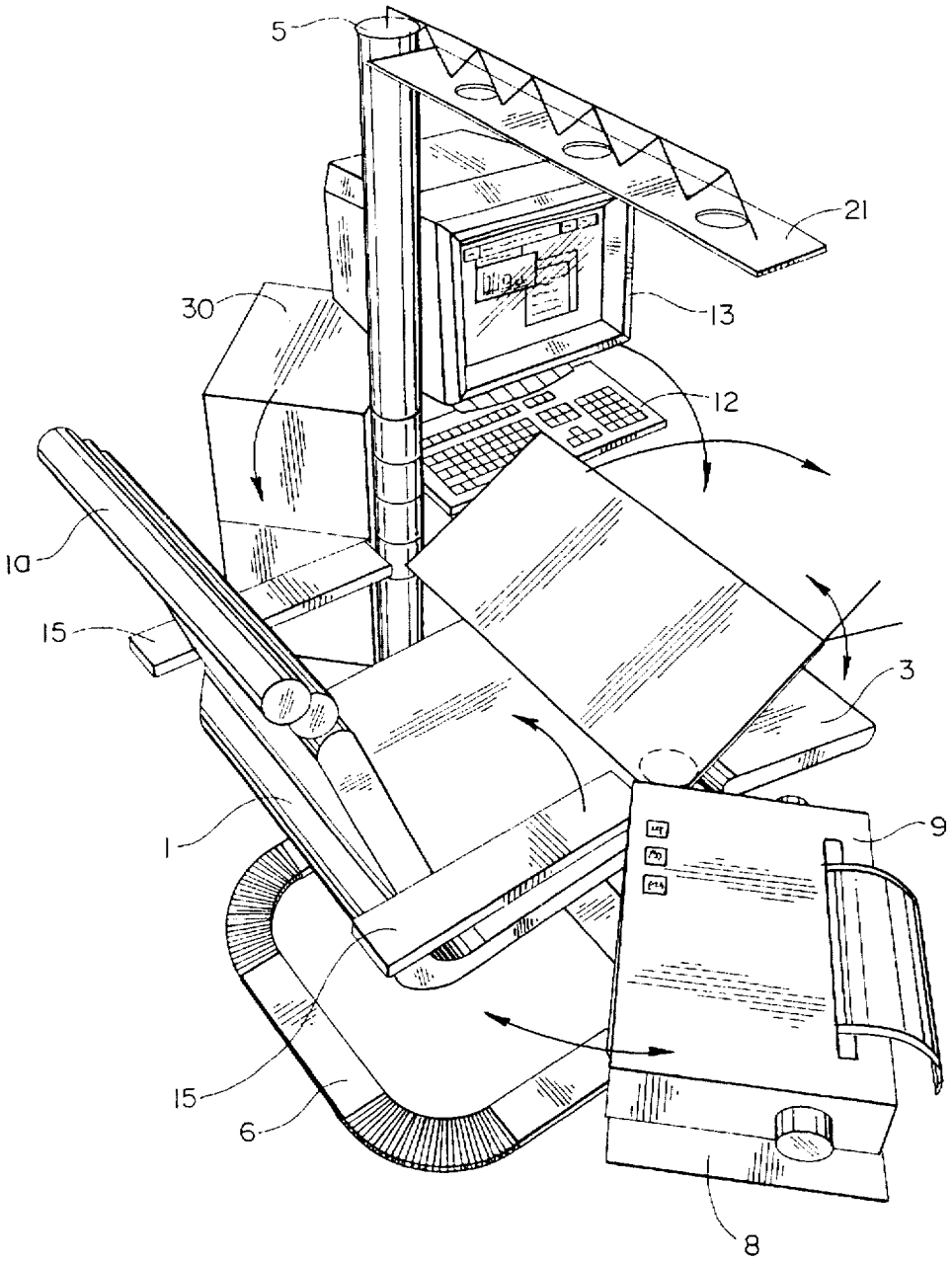
FIG. 1 three-quarter view from above of a work station according to the present invention.
Figure 2:
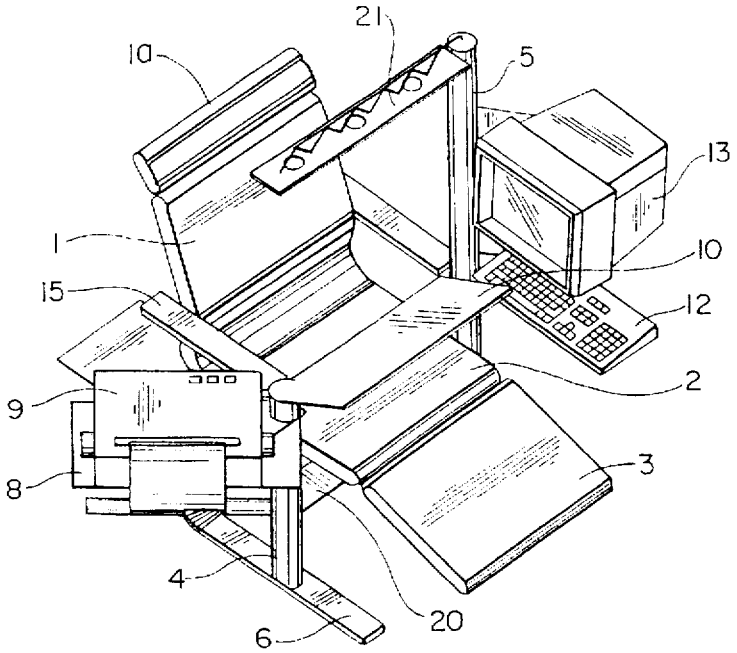
FIG. 2 is other three-quarter view from above of the work station shown in FIG. 1.
Figure 3:
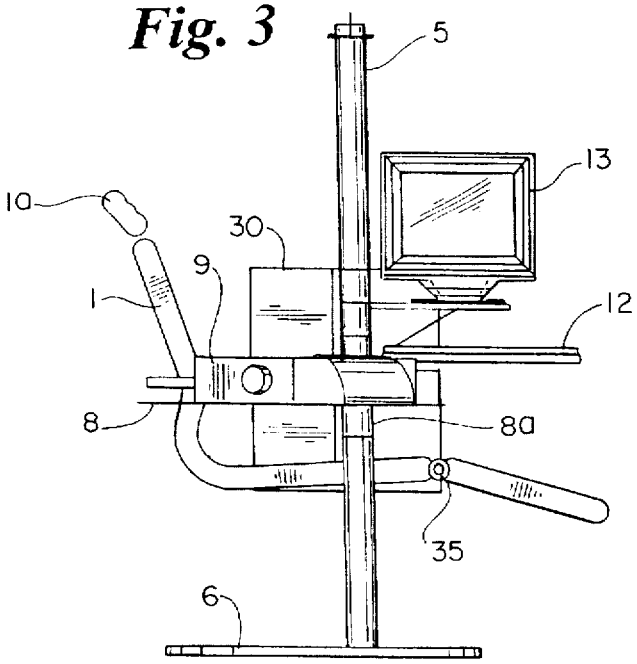
FIG. 3 is a side-elevational view of the typical work station according to this invention.

As can be seen from the drawings the work station comprises a chair which has a back rest 1, a head rest 1*a*, a seat 2 and foot rest 3. The foot rest 3 is so formed that it is pivotally connected by a pivot mean 35 to the seat 2 so that the angle between the foot rest 3 and the seat 2 can be varied as required. Suitable means (not shown in the drawings) are provided to enable the foot rest 3 to be retained at the desired angle to the seat 2. The back rest 1, head rest 1*a*, seat 2 and foot rest 3 are supported from the ground or surface on which the work station is to rest by stanchions 4 and 5. Preferably, but not necessarily one stanchion, such as the stanchion 5 is of greater height than the stanchion 4 but this arrangement can be varied as required.

The stanchions 4 and 5 are attached to a chair base 6 and extend upwardly from the base in a direction substantially parallel to each other. Preferably each stanchion is formed of a metal tube or the like over which a series of sleeves are engaged. The various items that will form part of the work station are each attached to an appropriate sleeve, each of which acts as a spacer so that the items will be supported at a desired height. For instance the chair is supported on each stanchion by being suitably attached to a sleeve. The height of the chair above the chair base is set by the height of the sleeve and by any intermediate spacers and/or sleeves between the chair base and the sleeve from which the chair is suspended. Similarly other items can also be supported on the stanchion by being individually attached to sleeves. The various sleeves are engaged on the stanchion in the desired order so that the various items will be at the appropriate height. For instance as indicated in the drawings, an accessory table 8 is supported on the stanchion 4 by means of a sleeve 8*a* and this accessory table 8 can then be utilized to support for instance a printer as indicated at 9 in the drawings. The stanchion 4 may also support a work table 10 which is so attached to a sleeve that the angle of the work table in relation to the horizontal can be suitably adjusted and set. In addition, because the table 10 is attached to a sleeve it can be swung out of the way as required to provide access to the chair.

Items such as a key board 12 for the computer and the computer monitor indicated at 13 can also be supported by sleeves engaged over the stanchion 5 so that these items can also be swung to the desired position.

The chair also includes arms 15 which may be attached to the back rest 1 in a manner that they be pivoted from a rest position as indicated by the arrow to facilitate access to the chair.

Preferably the work station also includes a power reticulation beam 20 through which the electrical and data communications supply lines can be led. The beam 20 can include if desired electrical and data outlets (not shown in the drawings) to supply power and or communications to the various items.

Preferably also the work station includes an overhead lighting arrangement such as that indicated at 21 with the electrical power lines being housed in a stanchion 5. Suitable switch and/or dimmer control for the lighting apparatus 21 can be included either on the stanchion or at other convenient location on the work station.

A storage unit such as that indicated at 30 can also be provided with the work station.

Although not shown in the drawings, the work station can also include suitable equipment capable of reproducing audible signals from recorded or broadcast sound or for reproducing sounds generated by the computer when it forms part of the work station. To achieve a satisfactory spread of sound, one or more loud speakers may be positioned at or near the head rest of the chair.

It will thus be seen that by provision of the work station hereinbefore described a single unit can be provided which will enable all of the equipment to be located in one place and to be readily moveable as a unit when desired.

Various modifications and/or improvements to the invention as herein described will be apparent to those skilled in the art and all such improvements and modifications are intended to be included within the scope of the present invention.

I claim:

1. A work station comprising a chair base, at least two stanchions projecting upwardly from the chair base, a plurality of sleeves engaged on each of the said stanchions, a support member attached to at least one of said sleeves to extend from said sleeve in a direction substantially normal to the longitudinal axis of the stanchion, said support member being adapted to support an item of equipment and wherein the work station also includes a chair supported on said stanchions by chair sleeves attached to said chair, which sleeves are engaged over at least two of said stanchions with the height of the chair above the chair base being determined by locating sleeves on the stanchions between the chair base and the chair sleeve.

2. The work station as claimed in claim 1, wherein the chair comprises a back rest, a foot rest and a seat, the said foot rest being pivotally connected to the said seat in a manner that the angle between the foot rest and the seat can be varied.

3. The work station as claimed in claim 1, wherein the said stanchions extend from the chair base substantially parallel to each other.

4. The work station as claimed in claim 1 including an electric power reticulation beam to house electrical and data communication lines.

5. The work station as claimed in any one of the preceding claims including means to transduce electrical signals into audible sound.

* * * * *